US009616971B2

(12) United States Patent
Gai

(10) Patent No.: US 9,616,971 B2
(45) Date of Patent: Apr. 11, 2017

(54) CONTROL DEVICE FOR A TRIM TAB OF A BOAT

(71) Applicant: Giorgio Gai, Busalla (IT)

(72) Inventor: Giorgio Gai, Busalla (IT)

(73) Assignee: ULTRAFLEX S.P.A., Busalla (GE) (IT)

( * ) Notice: Subject to any disclaimer, the term of this patent is extended or adjusted under 35 U.S.C. 154(b) by 0 days.

(21) Appl. No.: 13/960,057

(22) Filed: Aug. 6, 2013

(65) Prior Publication Data

US 2013/0312651 A1 Nov. 28, 2013

Related U.S. Application Data

(63) Continuation-in-part of application No. 13/238,124, filed on Sep. 21, 2011, now abandoned.

(30) Foreign Application Priority Data

Oct. 1, 2010 (IT) ..... GE2010A0110

(51) Int. Cl.

| | |
|---|---|
| ***B63B 1/22*** | (2006.01) |
| ***B63H 21/22*** | (2006.01) |
| ***B63B 39/06*** | (2006.01) |
| *B63H 20/08* | (2006.01) |

(52) U.S. Cl.

CPC ..... *B63B 1/22* (2013.01); *B63B 39/061* (2013.01); *B63H 20/08* (2013.01); *B63H 21/22* (2013.01)

(58) Field of Classification Search

CPC ..... B63B 1/22; B63B 39/061; B63H 21/22; B63H 20/12; B63H 20/08; B63H 20/10

USPC ..... 440/80, 86; 701/21

See application file for complete search history.

(56) References Cited

U.S. PATENT DOCUMENTS

| | | | | |
|---|---|---|---|---|
| 4,908,766 | A * | 3/1990 | Takeuchi | 701/21 |
| 5,385,110 | A * | 1/1995 | Bennett | B63B 39/061 114/285 |
| 7,311,058 | B1 * | 12/2007 | Brooks et al. | 114/285 |
| 7,958,837 | B1 * | 6/2011 | Fraleigh | 114/285 |
| 8,631,753 | B2 * | 1/2014 | Morvillo | B63B 39/061 114/285 |

* cited by examiner

*Primary Examiner* — Andrew Polay
(74) *Attorney, Agent, or Firm* — Themis Law

(57) ABSTRACT

In one embodiment, a control device for a trim tab of a boat includes a plurality of stabilizers, one of each provided on each side of the boat, and a joystick. The stabilizers include blades and a control actuator for each blade, which determines the regulation of the angle of each blade in respect of a plane identifying the transom of the boat. The joystick is connected to a control circuit, which generates a command signal based on a movement of the joystick and coordinates the position of each of the stabilizers, thereby causing the bow of the boat to move in the same direction as the joystick.

5 Claims, 7 Drawing Sheets

CONTROL DEVICE FOR A TRIM TAB OF A BOAT

FIELD OF THE INVENTION

The present invention relates to a control device for a trim tab of a boat. The trim tab includes at least a pair of stabilizers, one for each side of the boat, formed by blades and by a control actuator for each blade, which determines the regulation of the angle of each blade in respect of the plane identifying the transom of the boat.

In particular, the present invention refers to a control device for electromechanical actuators, for example in the nautical field and, in particular, for trim tabs for pleasure boats.

BACKGROUND OF THE INVENTION

Control devices of actuators are known, which use keyboards and buttons to operate the trim tabs of pleasure boats. These tabs are generally placed astern, sometimes under the hull of the boat, and include stabilizers, which usually consist of metal plates, and hydraulic or electromechanical cylinder actuators, which determine the change in angle of the stabilizers compared to the ideal flat surface of water. Such plates are attached to the hull of the boat with a hinge.

Sometimes these stabilizers are also equipped with sensors that can detect, minute by minute, the angle of the plate so that the trim can be controlled more effectively.

SUMMARY OF THE INVENTION

The present invention provides an effective control device for this type of trim tab actuator for vessels able to determine, in a simple, quick and effective way, the movements that are to be carried out on the boat. This kind of effect may be obtained through a joystick device that allows the lever of the joystick to be moved manually reproducing the same movement that one wants the boat to make.

Consequently the subject of this invention relates to a control device for trim tab actuators for vessels having the characteristics that are described hereinafter.

The control device of the present invention comprises a joystick connected to a control circuit that generates a command signal on the basis of the movement of the said joystick, which command signal coordinates the position of each of the said stabilizers in such a way that the bow of the boat moves in the same direction of the said joystick.

This arrangement allows obtaining a coordinate movement of the stabilizers in order to adjust the trim of a boat.

The operator does not need to know the position of the stabilizers, he just have to decide where he wants to direct the boat and to move the joystick accordingly.

This configuration brings the operator to an intuitive control of the boat.

According to a preferred embodiment, the movement of the joystick controls the actuators, in order to determine the positioning of the stabilizers according to predetermined conditions.

Preferably four different predetermined conditions can be identified:

forward movement of the joystick that corresponds to a lowering of the stabilizers and to a consequent lowering of the bow, backward movement of the joystick that corresponds to an uplift of the stabilizers and to a consequent uplift of the bow, leftward movement of the joystick that corresponds to a lowering of the right-side stabilizer and to an uplift of the left-side stabilizer. The boat in this case moves on the left;

rightward movement of the joystick that corresponds to a lowering of the left-side stabilizer and to an uplift of the right-side stabilizer. The boat in this case moves on the left.

The device according to the present invention preferably is constituted by an electro-mechanical system.

Each actuator includes an electric motor activated by electric signals generated by the said control circuit, in order to transform the movement of the said joystick in operation of motors of each actuator.

Providing an electro-mechanical system allows creating whatever type of equivalent circuits, which use different principles to achieve the same function.

As an example, the control circuit can comprise a Hall effect sensor, which takes the movements of the joystick in input and generates corresponding electric signal activating the electric motors of the actuator.

In a preferred embodiment, the control circuit comprises switches positioned to take advantage of a reverse polarity voltage for reversing rotation of DC motors of the actuators and consequently causing a movement of the actuators.

BRIEF DESCRIPTION OF THE DRAWINGS

The characteristics and advantages of the device according to this invention will be more apparent from the following description of its typical implementation, as an example but not limited to this, referring to the attached figures which illustrate in particular.

DETAILED DESCRIPTION OF EMBODIMENTS OF THE INVENTION

Detailed descriptions of embodiments of the invention are provided herein. It is to be understood, however, that the present invention may be embodied in various forms. Therefore, the specific details disclosed herein are not to be interpreted as limiting, but rather as a representative basis for teaching one skilled in the art how to employ the present invention in virtually any detailed system, structure, or manner.

Figure 4:
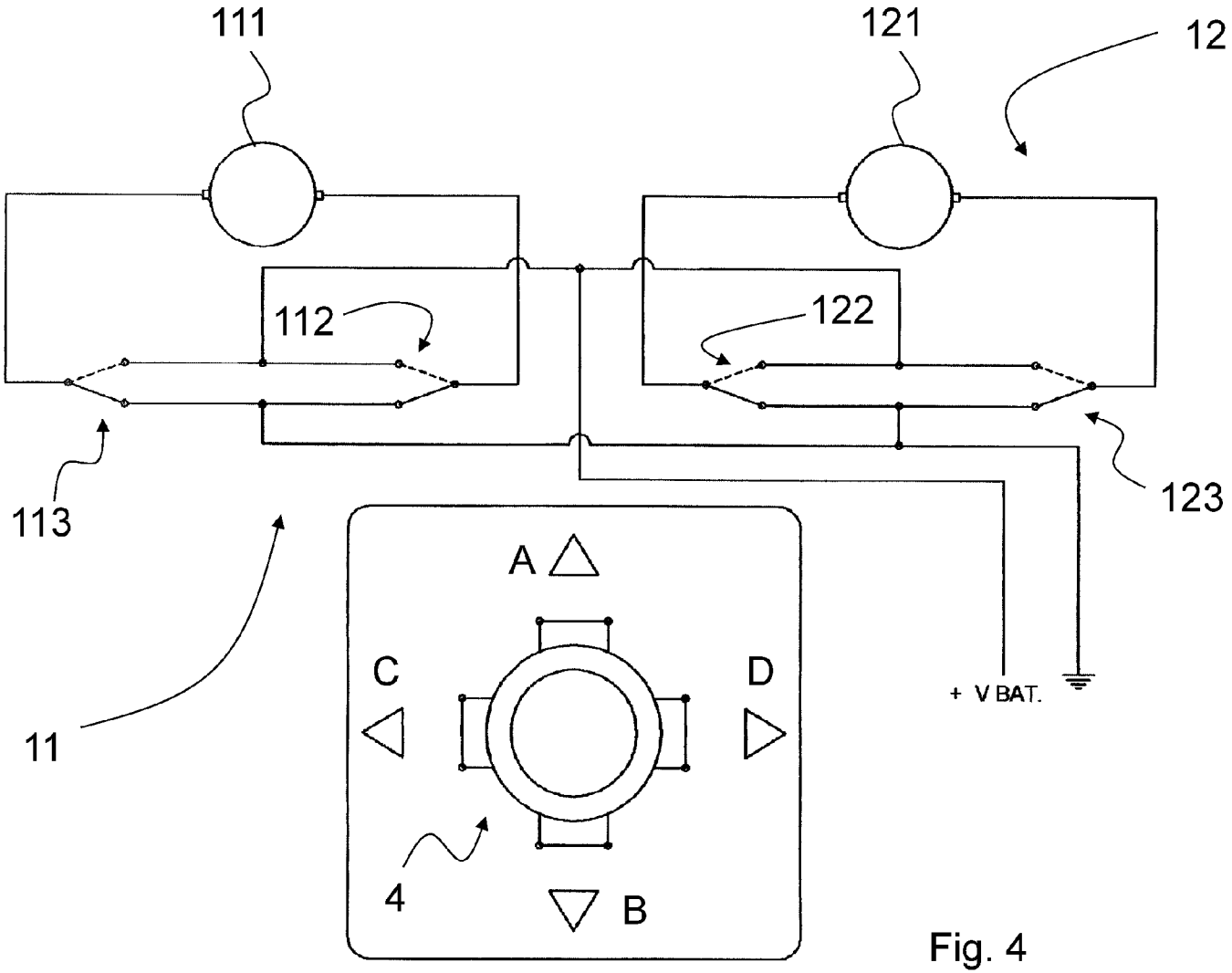
FIG. 4 illustrates a control circuit connecting the joystick with the actuators of the stabilizers.

With reference to the above mentioned figures, in particular FIG. 4, a trim tab for the boat is positioned at the stern of the same and is made up of a pair of stabilizers on each side of a boat B.

They are usually made up of plates or blades 2 in metallic materials and include a control actuator 3, such as a hydraulic or electromechanical cylinder, which determines the change in angle of the stabilizers compared to the ideal flat water surface. To this end, these plates are attached to the hull of the boat by means of a hinge 21.

The control device is capable of controlling the movement of the actuators and of determining the various conditions of the trim tab.

Figure 1:
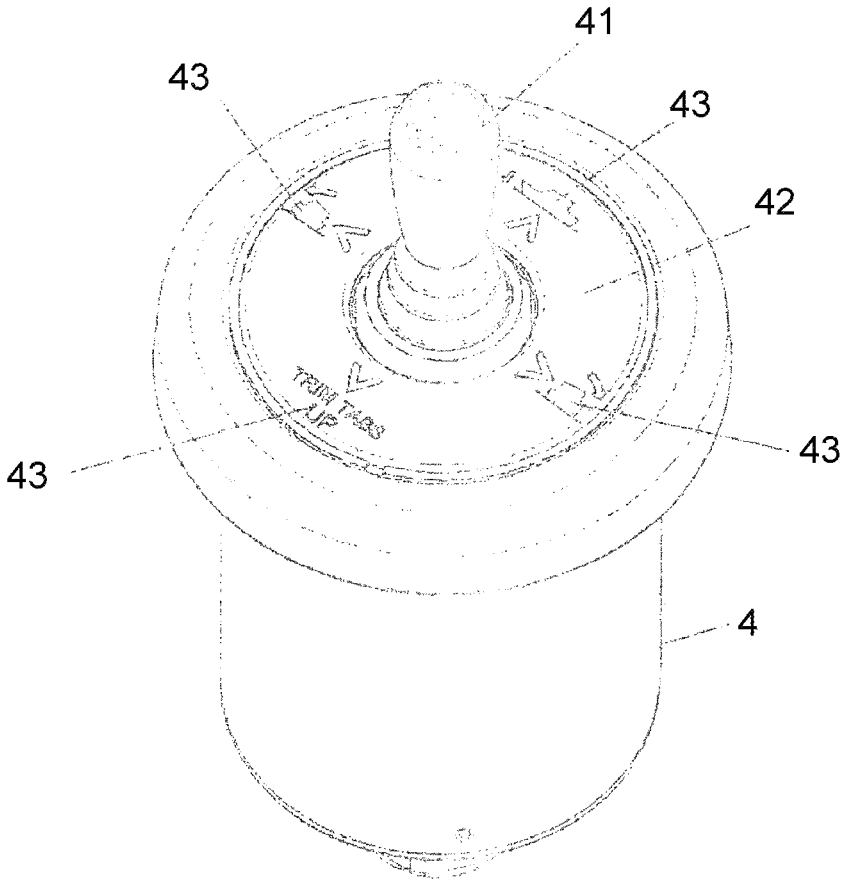
FIG. 1 illustrates a control device according to this invention in perspective view.
Figure 2:
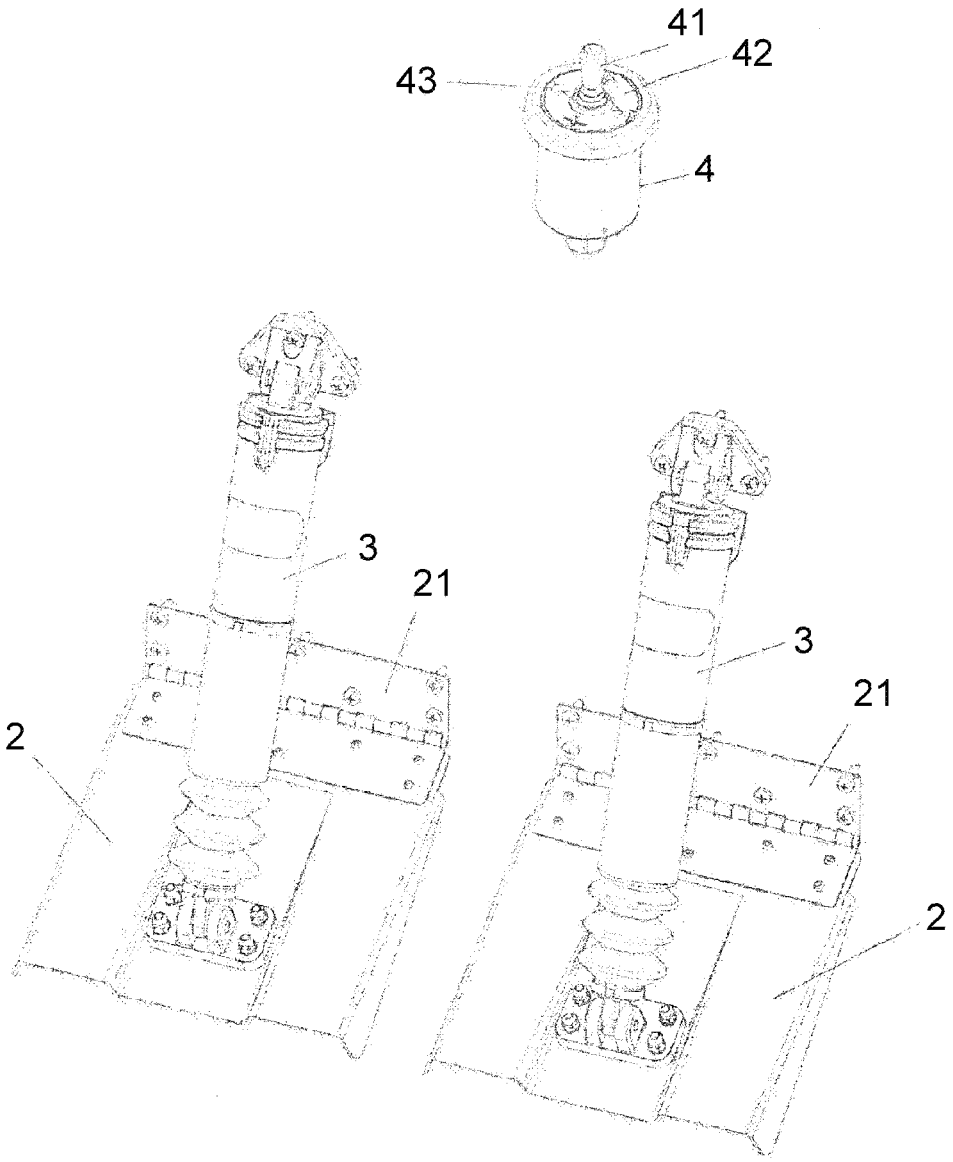
FIG. 2 illustrates a control device and the complex structure of the elements of the trim tab according to the present invention.

Referring now to FIG. 1, the control device includes a container body 4, in which the switches and the control circuit are inserted. On top of this there is a joystick 41 or actuation handle of the device placed in the center of a circumference 42, which presents graphic indications 43 of the various conditions of trim tab of the boat.

With its movement the joystick controls such actuators in order to determine the positioning of the stabilizers to reach certain predetermined conditions of the trim tab.

In FIGS. 3*a*-3*d* just as many conditions of the trim tab are shown. In particular, in FIG. 3*a*, the condition of the trim tab is shown that is used to lower the bow of the boat with the actuators completely or partially opened to lower the stabilizers. The joystick does a forward movement that corresponds to a lowering of the said stabilizers and to a consequent lowering of the bow.

Figure 3A:
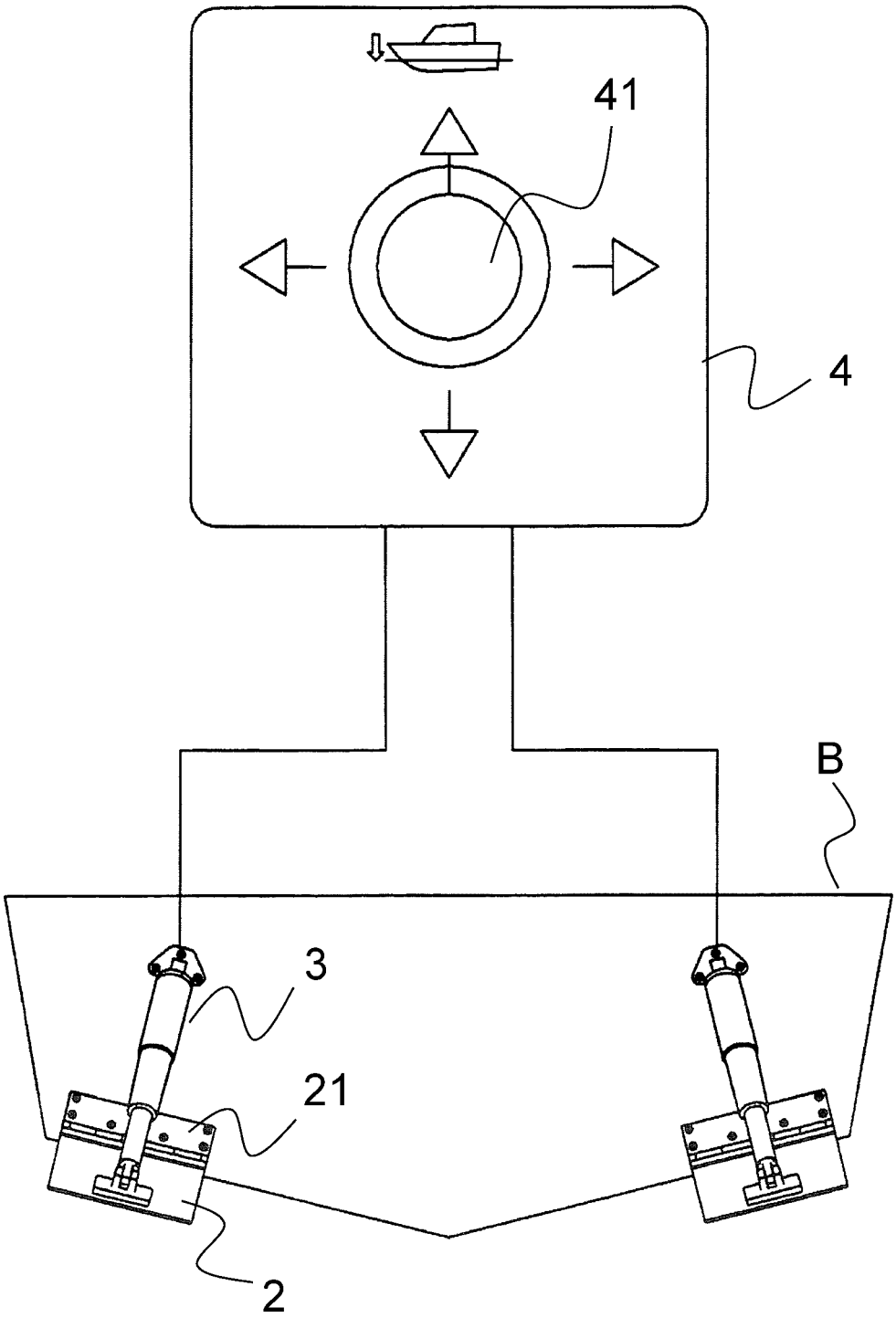
FIGS. 3*a*, 3*b*, 3*c* and 3*d* illustrate the four positions of the joystick in relation to the same number of conditions of a trim tab.
Figure 3B:
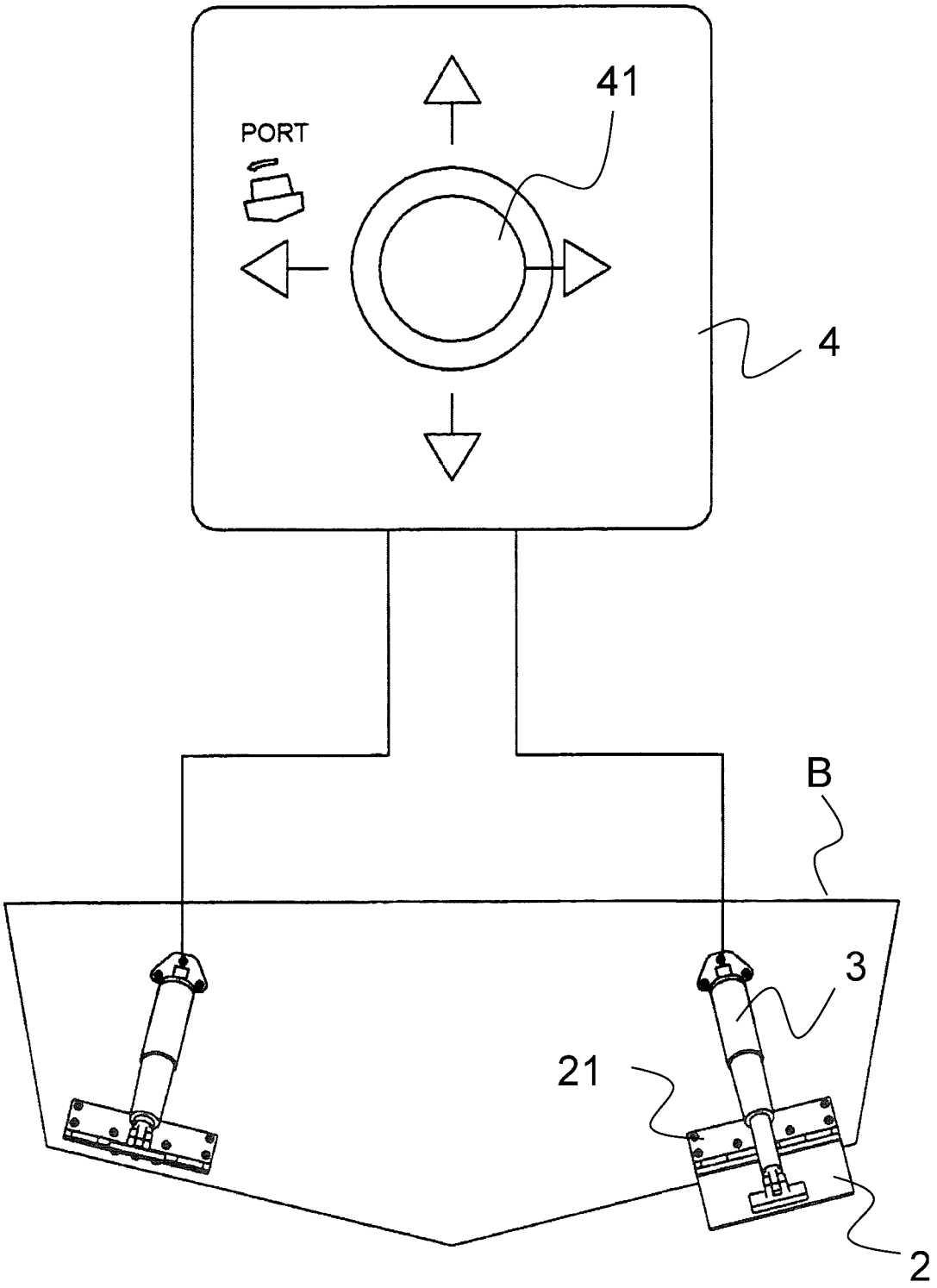

In FIG. 3*b* the bow moves on the left, the joystick does a leftward movement that corresponds to a lowering of the right-side stabilizer and to an uplift of the left-side stabilizer.

Figure 3C:
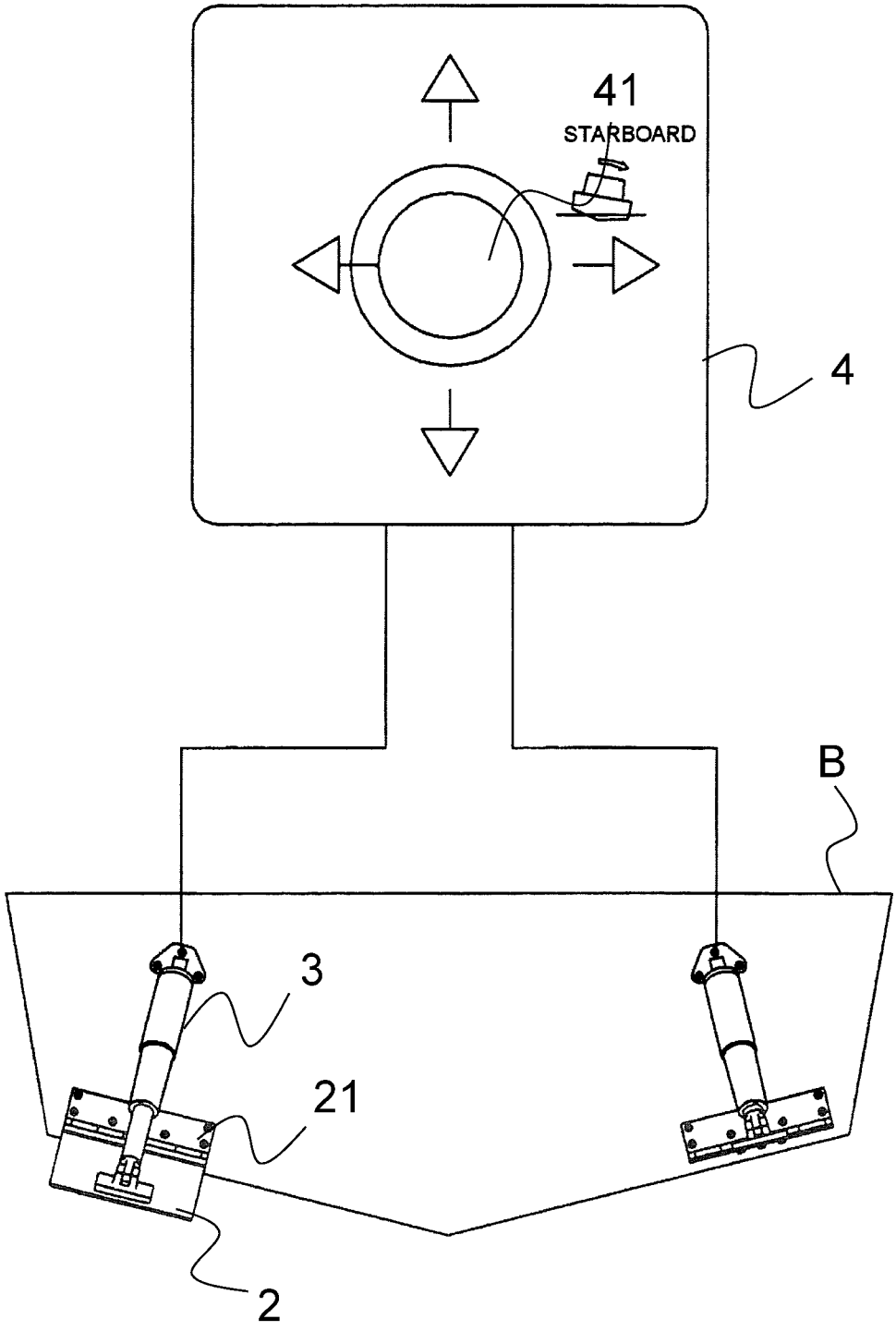

In FIG. 3*c* the bow moves on the right, the joystick does a rightward movement that corresponds to a lowering of the left-side stabilizer and to an uplift of the right-side stabilizer.

Figure 3D:
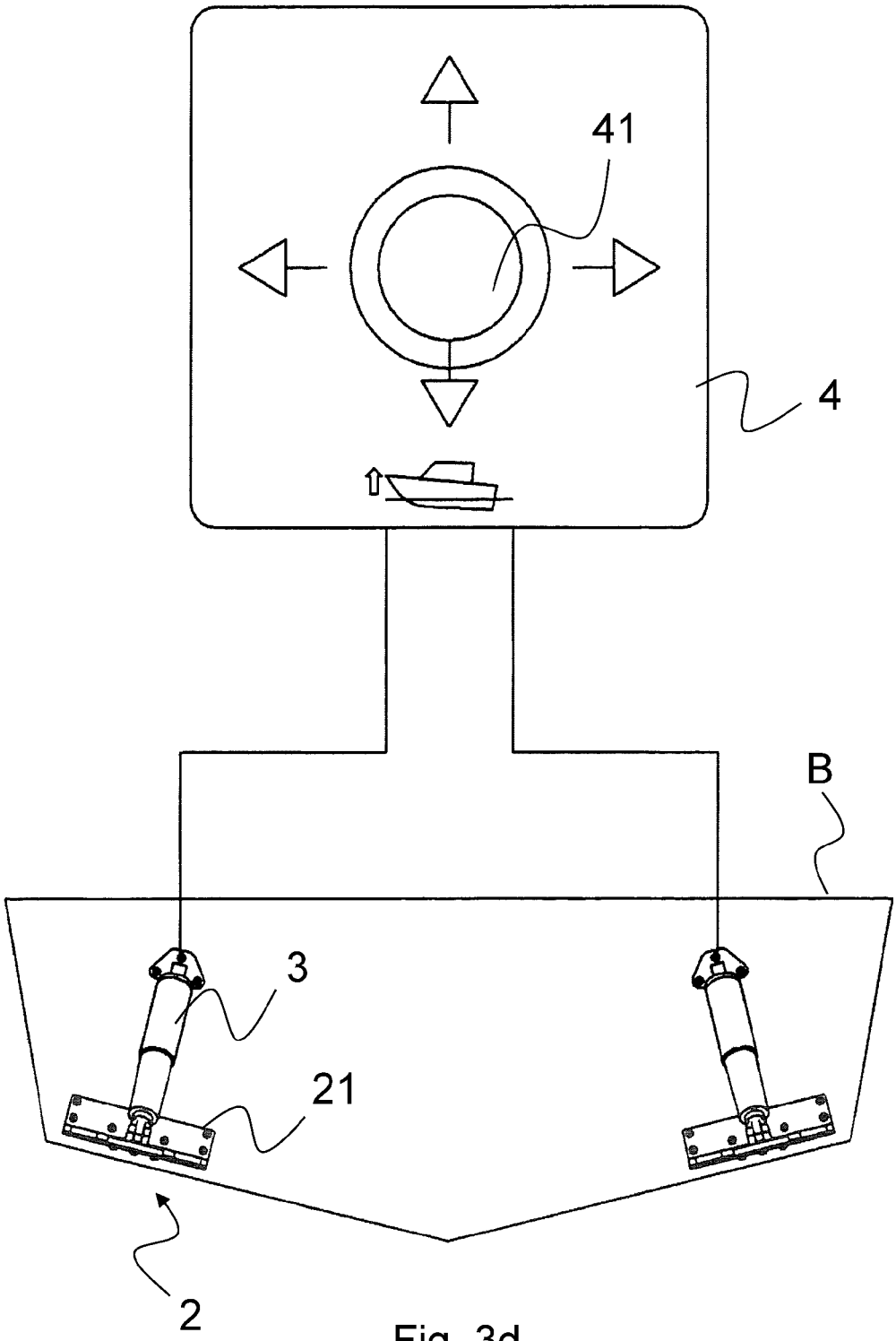

In FIG. 3*d*, the condition is shown that enables an operator to raise the stabilizers completely using the actuators when the trim of the boat does not require corrections or when the vessel is maneuvering or mooring at the quayside. The joystick does a backward movement that corresponds to an uplift of the stabilizers and to a consequent uplift of the bow.

A predetermined movement of the joystick corresponds to each of the above conditions in such a way as to operate a switch. In particular to achieve the condition of stabilizers raised, the joystick is moved back; to reach the condition of the bow lowered, the joystick is moved forward; to correct a listing to starboard, the joystick is moved to port; and, finally, in order to correct the listing to port, the joystick is moved to starboard.

Preferably, moving the joystick in each of the four directions, orthogonal to one another, determines the command corresponding to one of the four above mentioned conditions through the activation of at least one of the four switches. Advantageously, the mutually orthogonal directions refer to the dial of a clock, respectively, forward at 12 o'clock, back at 6 o'clock, starboard at 3 o'clock and port at 9 o'clock.

Switches can be positioned in the control circuit to take advantage of a reverse polarity voltage to reverse the rotation of DC motors and, therefore, cause the movement of the actuators. Similarly, other equivalent circuits can be made, which use different principles to achieve the same function.

One possible solution of the control circuit is illustrated in FIG. 4, wherein the control circuit is composed of two circuits 11 and 12, one for each actuator.

Each DC motor 111 and 121 of each actuator is connected to at least two switches 112, 113, 122, 123 which are alternatively activated by the movement of the said joystick 4.

Referring to FIG. 4, in one embodiment the switches can be constituted by single pole double throw devices (SPDT).

In particular, the switches 112 and 122 activate the motors 111 and 121 in order to lower the stabilizers, while the switches 113 and 123 activate the motors 111 and 121 in order to uplift the stabilizers.

The configuration of the control circuit is such that if the joystick 4 moves in the direction indicated by arrow A, the switches 112 and 123 are activated, causing the lowering of the bow.

If the joystick 4 moves in the direction indicated by arrow B, the switches 113 and 122 are activated, causing the uplift of the bow.

If the joystick 4 moves in the direction indicated by arrow C, the switches 112 and 122 are activated, and the boat turns on the left.

If the joystick 4 moves in the direction indicated by arrow D, the switches 113 and 123 are activated, and the boat turns on the right.

While the invention has been described in connection with the above described embodiments, it is not intended to limit the scope of the invention to the particular forms set forth, but on the contrary, it is intended to cover such alternatives, modifications, and equivalents as may be included within the scope of the invention. Further, the scope of the present invention fully encompasses other embodiments that may become apparent to those skilled in the art and the scope of the present invention is limited only by the appended claims.

The invention claimed is:

1. A control device for a trim tab of a boat comprising:

a trim tab comprising a pair of stabilizers, one stabilizer being disposed on each side of the boat and comprising a blade and a control actuator for the blade, the control actuator regulating an angle of the blade in respect of a plane identifying a transom of the boat; and a joystick connected to a control circuit which generates a non-transitory command signal based on a movement of the joystick, the non-transitory command signal coordinating a position of each of the stabilizers, thereby causing a bow of the boat to move in a same direction as the joystick, wherein each control actuator includes a DC motor, wherein the control circuit generates electric signals activating the DC motor, thereby transforming a movement of the joystick in operation of the DC motors of the control actuator, wherein the control circuit comprises switches positioned to take advantage of a reverse polarity voltage for reversing rotation of the DC motors of the actuators and cause a movement of the control actuators, wherein the control circuit comprises two circuits, one of the two circuits being provided for each actuator, each circuit having at least two switches operatively coupled to one another in parallel, each DC motor of each actuator being connected to the at least two switches which are alternatively activated by the movement of the joystick, wherein the joystick is configured as a handle extending from an upper surface of a housing, the upper surface being visible to a user, and wherein the upper surface has icons thereon, the icons being disposed in cross-wise positions and being shaped as pictorial symbols that depict the boat and an orientation of the boat in relation to a water line after actuation of the trim tabs in response to a displacement of the handle toward one of the icons.

2. The control device according to claim 1, wherein the movement of the joystick controls the actuators and determines a positioning of the stabilizers according to predetermined conditions, whereby a forward movement corresponds to a lowering of the stabilizers and to a consequent lowering of the bow, a backward movement corresponds to an uplift of the stabilizers and to an uplift of the bow, a leftward movement corresponds to a lowering of the stabilizer on a right side and to an uplift of the stabilizer on a left side, causing the bow to move to the left, and a rightward movement corresponds to a lowering of the stabilizer on the left side and to an uplift of the stabilizer on the right side, causing the bow to moves the right.

3. The control device according to claim 1, wherein the control circuit comprises a Hall effect sensor.

4. A control device for a trim tab of a boat comprising:

a joystick connected to a control circuit which generates a non-transitory command signal based on a movement of the joystick, the non-transitory command signal coordinating a position of stabilizers of the boat, thereby causing a bow of the boat to move in a same direction as the joystick, wherein the joystick is configured as a handle extending from an upper surface of a housing, the upper surface being visible to a user, and wherein the upper surface has icons thereon, the icons being disposed in cross-wise positions and being shaped as pictorial symbols that depict the boat and an orientation of the boat in relation to a water line after actuation of the stabilizers in response to a displacement of the handle toward one of the icons.

5. The control device according to claim 4, wherein the movement of the joystick determines a positioning of the stabilizers according to predetermined conditions, whereby a forward movement of the joystick corresponds to a lowering of the stabilizers and to a consequent lowering of the bow, a backward movement corresponds to an uplift of the stabilizers and to an uplift of the bow, a leftward movement corresponds to a lowering of the stabilizer on a right side and to an uplift of the stabilizer on a left side, causing the bow to move to the left, and a rightward movement corresponds to a lowering of the stabilizer on the left side and to an uplift of the stabilizer on the right side, causing the bow to moves the right.

* * * * *